US005333673A

United States Patent [19]

Hughes

[11] Patent Number: 5,333,673

[45] Date of Patent: Aug. 2, 1994

[54] METAL CASTING IN A SAND MOLD HAVING A SODIUM BENTONITE CLAY BINDER MIXTURE

[75] Inventor: John Hughes, Arlington Hgts., Ill.

[73] Assignee: American Colloid Company, Arlington Heights, Ill.

[21] Appl. No.: 127,195

[22] Filed: Sep. 27, 1993

Related U.S. Application Data

[62] Division of Ser. No. 336,095, Apr. 11, 1989, Pat. No. 5,275,114.

[51] Int. Cl.[5] ..... B22C 1/18; B22C 9/02

[52] U.S. Cl. ..... 164/528; 164/525

[58] Field of Search ..... 164/528, 525, 526, 527

[56] References Cited

U.S. PATENT DOCUMENTS

| | | | |
|---|---|---|---|
| 2,876,511 | 3/1959 | Baugh | 164/526 |
| 2,997,400 | 8/1961 | Greenewald, Jr. | 164/528 X |
| 3,431,123 | 3/1969 | Zrimsek et al. | 106/38.35 |
| 3,445,251 | 5/1969 | Nevins | 106/38.3 |
| 4,203,771 | 5/1980 | Matsui | 106/38.35 |
| 4,505,750 | 3/1985 | Cowan | 106/38.35 |

FOREIGN PATENT DOCUMENTS

| | | | |
|---|---|---|---|
| 52-47518 | 4/1977 | Japan | 164/528 |

*Primary Examiner*—J. Reed Batten, Jr.
*Attorney, Agent, or Firm*—Marshall, O'Toole, Gerstein, Murray & Borun

[57] ABSTRACT

Molten metal is cast into a mold cavity formed of sand held in a predetermined mold configuration by a binder comprising a plurality of sodium bentonite clays. A blend of two or more sodium bentonite clays obtained from different areas as a foundry sand binder synergistically and unexpectedly improves the foundry sand used as a mold cavity for casting metal objects by unexpectedly improving one or more of the following foundry sand properties beyond the level of either of the blended sodium bentonites alone: green compressive strength; hot compressive strength; dry compressive strength; wet tensile strength; flowability; surface finish; activation speed and shakeout.

5 Claims, 5 Drawing Sheets

METAL CASTING IN A SAND MOLD HAVING A SODIUM BENTONITE CLAY BINDER MIXTURE

This is a division of U.S. application Ser. No. 07/336,095, filed Apr. 11, 1989, and now U.S. Pat. No. 5,275,114.

FIELD OF THE INVENTION

The present invention is directed to clay binders formed from a mixture of sodium bentonites or water-swellable bent onites used as foundry sand binders in the casting of metal. More particularly, the present invention is directed to a foundry sand binder including a plurality of sodium bentonite clay binders mined from different areas having substantially and unexpectedly improve d green compressive strength, hot compressive strength , dry compressive strength, wet tensile strength, surface finish, actuation speed, shakeout, flowability, and/or developing speed.

BACKGROUND AND THE INVENTION AND PRIOR ART

Green sand molding is the production of molded metal objects from temper ed molding sand and is the most diversified molding process used to cast ferrous as well as non-ferrous metal castings. Green sand molding is favored by foundrymen because it is economical and permits both quality and quantity production, particularly for smaller castings. Castings as large as three to four tons are made successfully in green sand molds; however, as molds become larger, more time is required for the making and assembling of mold parts. Consequently, other types of molding are generally favored for the larger castings. The rapid collapsibility of green sand molds makes them much less resistant to the normal contraction of the castings while metal solidification takes place, thus minimizing problems of stresses and strains. Green sand is defined as a water tempered molding sand mixture with plasticity. A green sand mold used for casting steel usually consists of silica sand, a clay binder, and/or an organic binding agent mulled together with temper water. Other useful foundry sands include chromite, zircon and olivine sands.

One or more binders mixed with the silica sand are essential to maintain the sand in a predetermined mold configuration. One of the most commonly employed green sand binders is clay, such as a water-swellable sodium bentonitc clay or a low swellable calcium bentonitc clay. The amount of the clay binder that is used together with the sand generally depends upon the particular type of sand used in the mixture and the temperature of firing. Silica sand grains expand upon heating. When the grains are too close, the molding sand moves and expands causing the castings to show defects such as "buckles" (a deformity in the casting resulting from excessive sand expansion), "rat tails" (a rough, irregular depression that appears on the surface of a casting or a minor buckle), and "scabs" (a breaking away of a portion of the molding sand when hot metal enters the mold). To overcome this harmful expansion, more clay is added to the sand mixture since the clay contracts upon firing thereby compensating for the expansion of the silica sand grains. In green sand molding, the reproducibility of the dimensions obtained on the casting are the result of such factors as shrinkage, changes in dimensions of mold cavity, hardness of mold, stability of molding sand, mechanical alignment of flask and maintaining a fixed temperature.

Clays have been blended in the past in an attempt to achieve acceptable combinations of permeabilities, green compression strengths and dry compression strengths in the molding sand mixture or composition. Toward this end, it is known to mix a sodium bentonite with a calcium bentonite or a kaolinite clay in an attempt to achieve the high dry compression strength of the sodium bentonite clay together with the high green compression strengths of the calcium bentonite clay and the low permeability of the kaolinate clay. See Foundry Sand Practice by Clyde A. Sanders, 6th Edition, 1973, p. 585–590. To date, however, a plurality of various sodium bentonite clays, each having particular desirable characteristics, have not been blended for the purpose of providing a binder to a foundry sand. Quite surprisingly, it has been found that when a mixture of sodium bentonites is used as a binder in the preparation of a foundry sand, synergism results with respect to green compressive strength; hot compressive strength; dry compressive strength; flowability; surface finish; activation speed; and/or shake-out. One or more of these properties are better in the blend than each of the sodium bentonites, prior to blending.

SUMMARY OF THE INVENTION

In brief, the present invention is directed to a foundry sand binder composition and method of manufacturing cast metal objects by casting molten metal into a mold cavity formed of sand held in a predetermined mold configuration by a binder comprising a plurality of sodium bentonitc clays. It has been found that a blend of two or more sodium bentonite clays obtained from different areas as a foundry sand binder synergistically and unexpectedly improves the foundry sand used as a mold cavity for casting metal objects by unexpectedly improving one or more of the following foundry sand properties beyond the level of either of the blended sodium bentonites alone: green compressive strength; hot compressive strength; dry compressive strength; flowability; surface finish; activation speed and shake-out.

Green compressive strength of a foundry sand is the maximum compressive stress that a sand mixture is capable of sustaining when prepared, rammed and tested according to standard procedure. Dry compressive strength is the maximum compressive stress that a dried sand mixture is capable of developing. Hot compressive strength of a foundry sand is the maximum compressive stress that a sand mixture is capable of sustaining when loaded between specific concave and convex refractor 4 discs in a furnace according to standard procedure. Flowability, in general terms, refers to the movement of sand grains when they are subjected to molding forces. Virtually every ingredient of a sand mixture has an effect on the flowability of a mixture, and one of the most important factors is the moisture content or degree of temper. The movement of sand grains during the molding operation is in more than one direction; lateral, as well as along the axis of load. The ability of a sand to flow under compaction forces is also affected by restrictions in area and by the depth of sand.

Accordingly, an object of the present invention is to provide a new and improved foundry sand binder comprising a mixture of sodium bentonire clays.

Another object of the present invention is to provide a new and improved foundry sand comprising a blend of sand, a mixture of sodium bentonite clays and temper water.

Another object of the present invention is to provide a new and improved foundry sand binder, foundary sand and method of molding cast metal objects by pouring molten metal against the foundry sand containing the new and improved foundry sand binder.

BRIEF DESCRIPTION OF THE DRAWINGS

These and other objects and advantages of the present invention will become apparent from the following detailed description of the preferred embodiments taken in conjunction with the drawings, wherein.

DETAILED DESCRIPTION OF THE PREFERRED EMBODIMENTS

Figure 1:
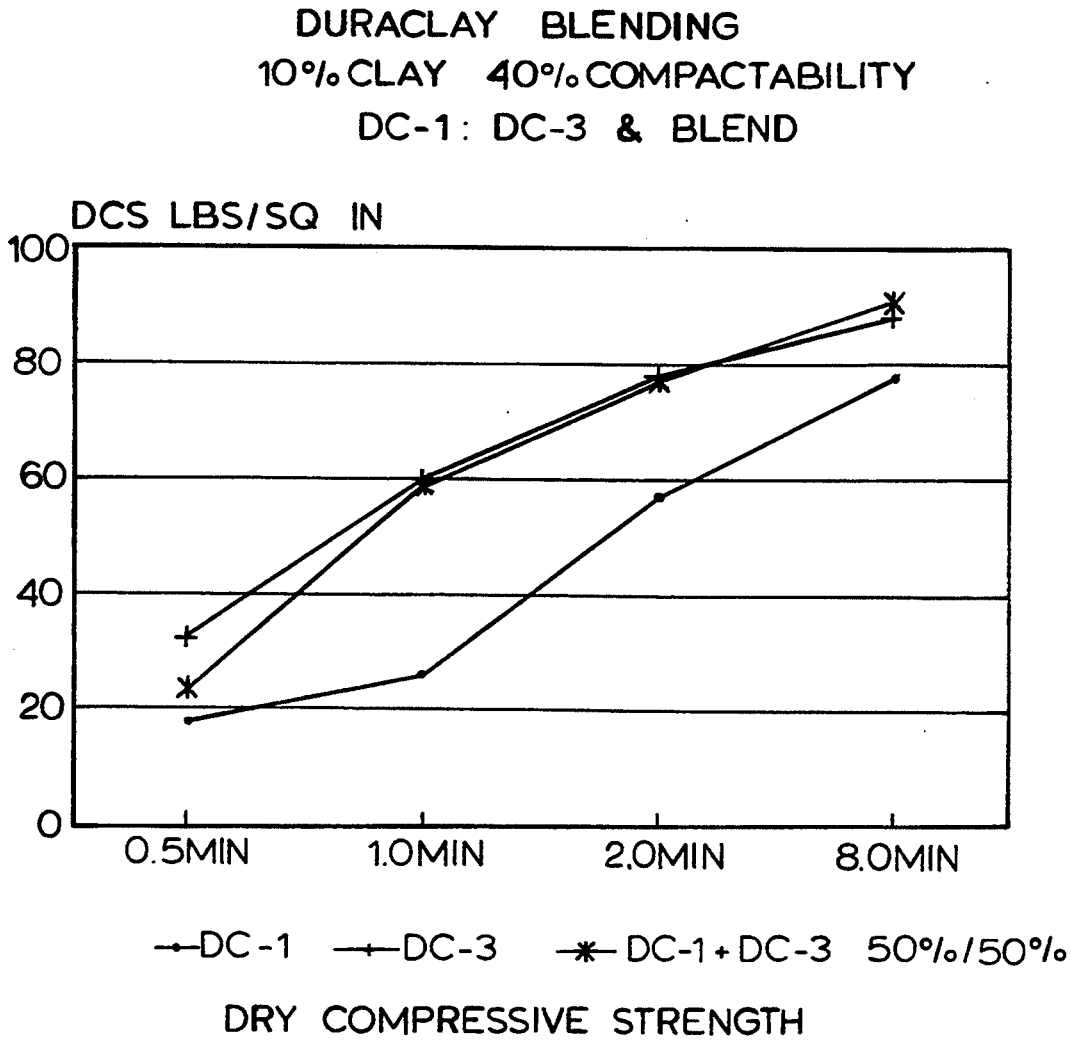
FIG. 1 is a graph of dry compressive strength (DCS) of a foundry sand containing 10% by weight of a binder containing 50% by weight DC-1 and 50% by weight DC-3 sodium bentonite clays compared to the DCS of each clay alone, showing synergistic development of the DCS after about 4 minutes of molding time.
Figure 2:
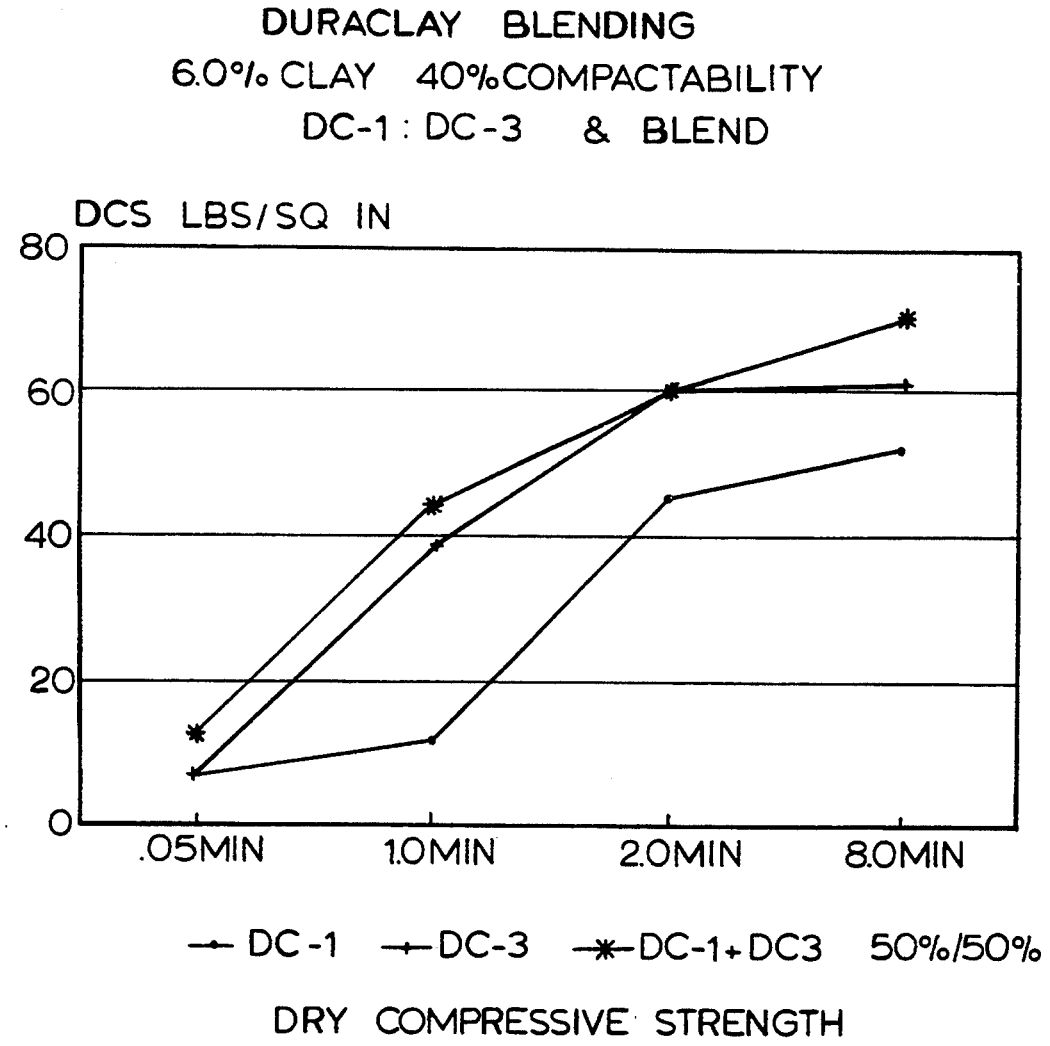
FIG. 2 is a graph similar to FIG. 1 showing the DCS of a foundry sand containing 6% by weight of a binder of a 50/50 blend of the DC-1 and DC-3 clays of FIG. 1 compared to the DCS of each clay alone.
Figure 3:
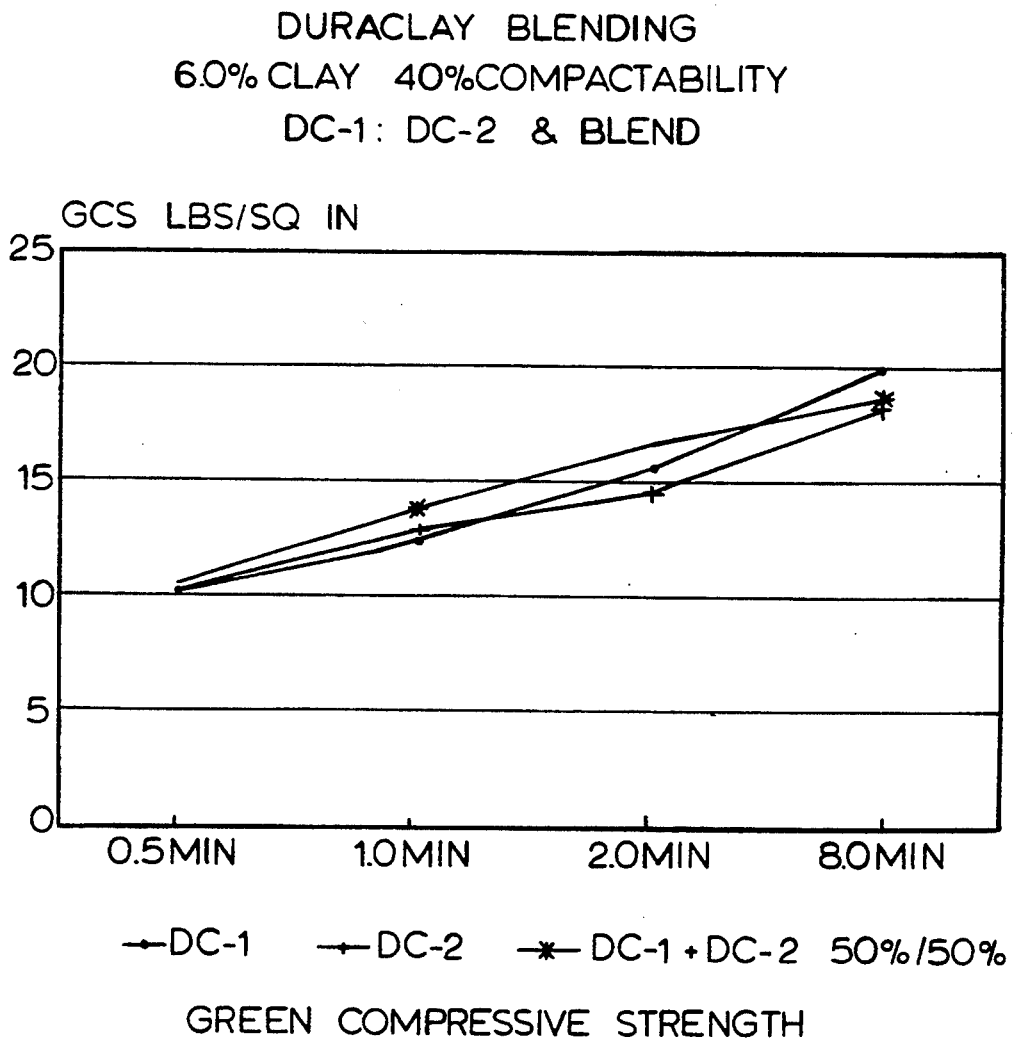
FIG. 3 is a graph similar to FIG. 1 showing the green compressive strength (GCS) of a foundry sand containing 6% by weight of a binder containing 50% by weight DC-1 and 50% by weight DC-2 sodium bentonite clays compared to the GCS of each clay alone showing synergistic development of the GCS through about 5 minutes of molding time.
Figure 4:
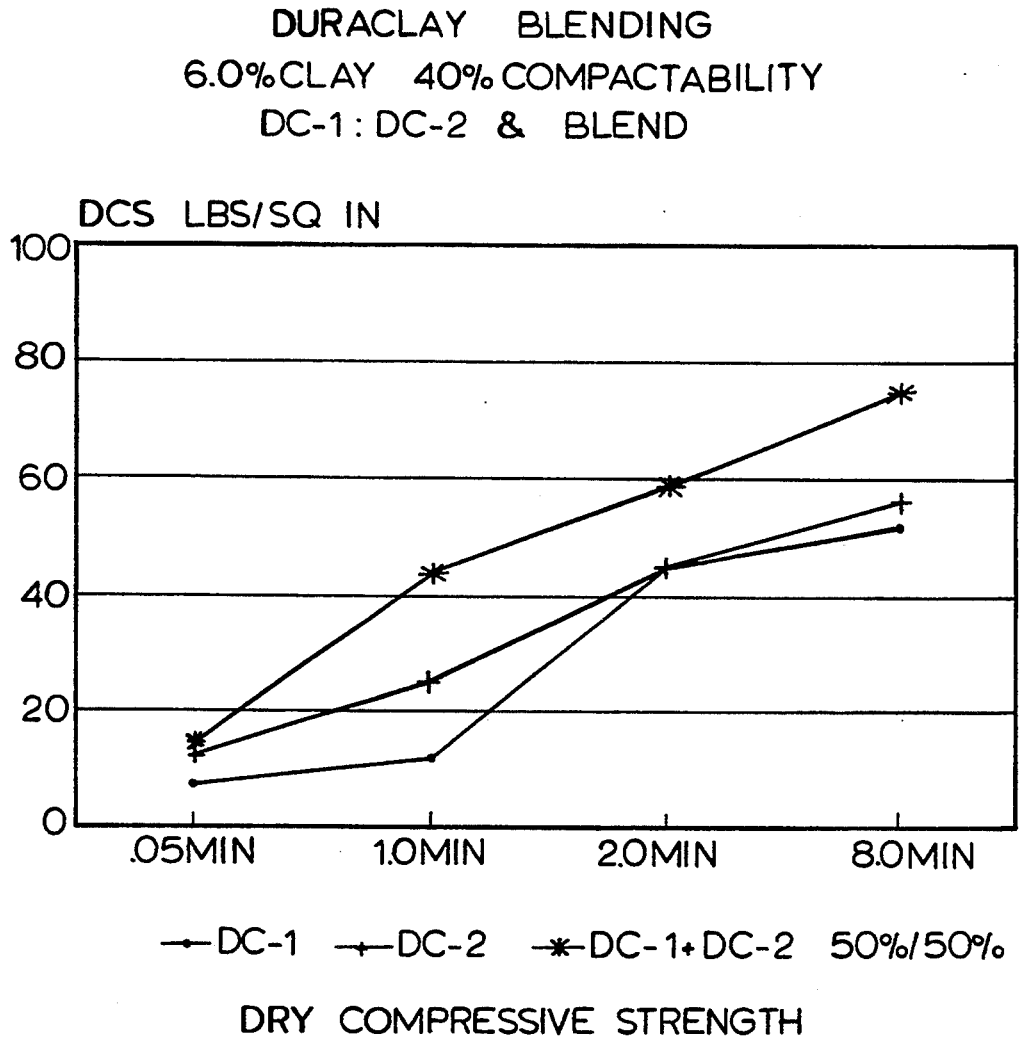
FIG. 4 is a graph similar to FIG. 3 showing the dry compressive strength (DCS) of a foundry sand containing 6% by weight of a binder containing 50% by weight DC-1 and 50% by weight DC-2 sodium bentonire clays compared to the DCS of each clay alone showing synergistic development of the DCS over the entire molding time.
Figure 5:
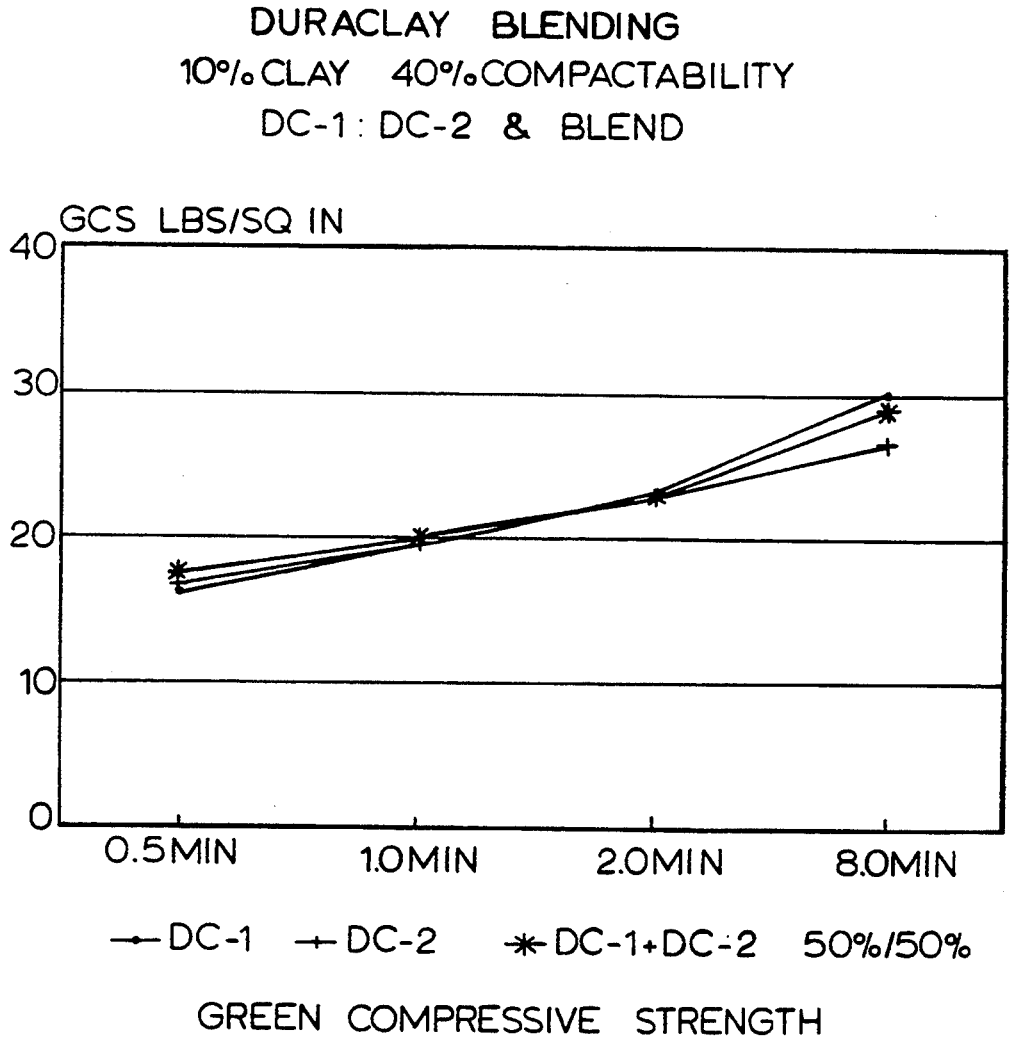
FIG. 5 is a graph similar to FIG. 3 showing the green compressive strength (GCS) of a foundry sand containing 10% by weight of a binder of a 50/50 by weight blend of DC-1 and DC-2 clays compared to the GCS of each clay alone.

It is known to mix a southern, calcium bentonite with a western, sodium bentonite, or to mix a sodium bentonite with a kaolinite or fire clay in an attempt to use the better contraction and shakeout properties of the southern bentonite, and its ability to prevent hot cracks and hot tears in castings; together with the Western sodium bentonite properties of higher dry, baked and hot strengths.

Other common additives for the foundry sands of the present invention include cellulose, cereal, or other fibrous additives included for the purpose of overcoming sand expansion defects, particularly those defects occurring on flat casting surfaces in an amount of about 0.5 to about 5% by weight of dry sand. Typical cellulose additives include wood flour and cereals such as rye flour, wheat flour, corn flour, oat hulls, rice hulls, alfalfa fines, grain chaff, flax seed pressings, corn cob flour, pulverized nut hulls, ground cotton-seed pulp after oil extraction, and the like. Cements, e.g., portland; natural cements, such. as heated, ground limestone, resins and the like in amounts of about 3% to about 6% by weight of the dry sand also can be added to foundry sand binders of the present invention.

Various other additives may be included in the foundry sand of the present invention, such as various blackings or other carbonaceous materials, such as graphite; pitch; charcoal; bituminous coal, or soft coal, such as seacoal; hard coal; and coke which can be used with, or as a partial clay substitute for wet coating to prevent metal penetration or burn-on; chemical agents, such as resin binders; china clay; oils, such as linseed oil and the like. These additional additives generally are included in amounts of less than about 1.0% by weight of the sand and, generally, in an amount of 0 to about 10% by dry weight total.

Western (sodium) bentonites are known to supply the required dry and hot strengths to prevent cutting, washing and eroding of the molds when metal passes over them. Western bentonite is more durable than southern bentonire, and requires less replacements in reused molding sand mixtures. Further, Western bentonite bonded molding sands have a more gummy feel than southern bonded sand mixtures when the temper water is added and mulled into sand mixtures. Western bentonite sand mixtures are said to be "tougher" and not as "brittle" as southern bonded molding sands prepared in the same manner. It is also known to treat calcium bentonite with a sodium carbonate treatment, a process known as peptizing, to convert the calcium bentonitc to a swelling sodium bentonire. Generally the clay or clay mixture is used in the silica sand in an amount of about 2% by dry weight up to about 15% based on the total dry weight of the foundry sand; generally about 3% to about 10% by weight based on the dry weight of the total sand content. It is understood in the foundry industry that by adding more clay binder to a foundry sand mixture, more water is also required. Therefore, it is often the case that by using less clay binder in a foundry sand mixture and reducing the amount of temper water added, the foundry sand mixture is just as strong as it was with a higher percentage of clay binder and water.

In accordance with an important feature of the present invention, it has been found that unexpected improvements in the foundry sand are achieved by blending two or more sodium bentonite or montmorillonite clays having different properties by virtue of the two sodium bentonires being mined from differently located mines.

Each sodium bentonite clay from different deposits when added to the same sand as a foundry sand binder for the casting of metal in molds can be tested in accordance with standard procedures and each different sodium bentonite provides a different value for green compressive strength, hot compressive strength, dry compressive strength, flowability, surface finish, activation speed and shakeout. Of these properties, the most important for the purpose of acting as a binder in a foundry sand for metal casting are green compressive strength and dry compressive strength. While the values for green compressive strength and dry compressive strength in any given sample of a sodium montmorillonite clay can vary from day to day, it has been found that by blending two or more sodium bentonite clays mined from different locations, and using this blend as a foundry sand binder, the green compressive strength and/or the dry compressive strength and/or the surface finish achieved from the blend will be greater than the green compressive strength, dry compressive strength and/or surface finish of either of the blended sodium bentonite clays alone. This is most surprising since it would be expected that a blend of two different clay binders would result in green compressive strengths and dry compressive strengths which are somewhere between the values for each of the individual clays alone.

In order to illustrate the new and unexpected results achieved in terms of green compressive strength, dry compressive strengths and/or surface finish by blending two or more sodium bentonite clays obtained from two different locations, different sodium bentonite clays were mined and each was designated with a different designation DC-1, DC-2, DC-3, DC-9 and DC-10. The individual clays had green compressive strengths (GCS) and dry compressive strengths (DCS) as shown in TABLE I:

TABLE I

| BASE CLAY | BLEND CLAY | INDIVIDUAL CLAYS % BLEND | SOURCE DATE MINED | GCS | DCS |
|---|---|---|---|---|---|
| | | | DC-1 | | |
| DC-1-A | | 100 | Colony Wyoming 1 5/16/88 | 10.6 | 128 |
| DC-1-B | | 100 | Colony Wyoming 1 5/23/88 | 10.8 | 122 |
| DC-1-C | | 100 | Colony Wyoming 1 7/5/88 | 10.9 | 132 |
| DC-1-D | | 100 | Colony Wyoming 1 7/11/88 | 10.6 | 130 |
| DC-1-E | | 100 | Colony Wyoming 1 7/18/88 | 11.2 | 110 |
| | | | DC-2 | | |
| DC-2-A | | 100 | Colony Wyoming 2 5/16/88 | 9.8 | 132 |
| DC-2-B | | 100 | Colony Wyoming 2 6/20/88 | 10.0 | 123 |
| DC-2-C | | 100 | Colony Wyoming 2 7/5/88 | 9.8 | 142 |
| DC-2-D | | 100 | Colony Wyoming 2 7/11/88 | 9.3 | 138 |
| DC-2-E | | 100 | Colony Wyoming 2 7/18/88 | 9.8 | 113 |
| | | | DC-3 | | |
| DC-3-A | | 100 | Upton Wyoming 5/16/88 | 9.3 | 133 |
| DC-3-B | | 100 | Upton Wyoming 6/6/88 | 10.2 | 110 |
| DC-3-C | | 100 | Upton Wyoming 7/5/88 | 9.8 | 127 |
| DC-3-D | | 100 | Upton Wyoming 7/11/88 | 9.7 | 135 |
| DC-3-E | | 100 | Upton Wyoming 7/18/88 | 10.2 | 117 |
| | | | DC-9 | | |
| DC-9-A | | 100 | Field-Sagebrush 5/16/88 | 10.3 | 132 |
| | | | DC-10 | | |
| DC-10-A | | 100 | Colony Wyoming 3 5/16/88 | 10.7 | 123 |

Blends of each of these clays in various proportions were found to have the green compressive strengths and dry compressive strengths set forth in TABLE II:

TABLE II

SODIUM BENTONITE BINDER MIXTURES

| BASE CLAY | BLEND CLAY | % BLEND | DATE MINED | GCS | DCS | MAX. OF INDIV. CLAYS GCS | MAX. OF INDIV. CLAYS DCS |
|---|---|---|---|---|---|---|---|
| DC-1-A | DC-2-A | 75/25 | 5/16/88 | 10.5 | 120 | | |
| DC-1-A | DC-2-A | 50/50 | 5/16/88 | 10.1 | 140 | 10.6 | 132 |
| DC-1-A | DC-2-A | 25/75 | 5/16/88 | 9.9 | 113 | | |
| DC-1-A | DC-3-A | 75/25 | 5/16/88 | 10.5 | 114 | | |
| DC-1-A | DC-3-A | 50/50 | 5/16/88 | 10.1 | 95 | 10.6 | 133 |
| DC-1-A | DC-3-A | 25/75 | 5/16/88 | 10.0 | 117 | | |
| DC-1-A | DC-9-A | 75/25 | 5/16/88 | 10.2 | 128 | | |
| DC-1-A | DC-9-A | 50/50 | 5/16/88 | 10.4 | 124 | 10.6 | 132 |
| DC-1-A | DC-9-A | 25/75 | 5/16/88 | 10.5 | 115 | | |
| DC-1-A | DC-10-A | 75/25 | 5/16/88 | 10.8 | 130 | | |
| DC-1-A | DC-10-A | 50/50 | 5/16/88 | 10.8 | 122 | 10.7 | 128 |
| DC-1-A | DC-10-A | 25/75 | 5/16/88 | 11.4 | 125 | | |
| DC-1-B | DC-2-B | 75/25 | 5/23/88–6/20/88 | 10.5 | 115 | | |
| DC-1-B | DC-2-B | 50/50 | 5/23/88–6/20/88 | 10.4 | 122 | 10.8 | 123 |
| DC-1-B | DC-2-B | 25/75 | 5/23/88–6/20/88 | 10.2 | 145 | | |
| DC-1-B | DC-3-B | 75/25 | 5/23/88–6/20/88 | 10.7 | 125 | | |
| DC-1-B | DC-3-B | 50/50 | 5/23/88–6/20/88 | 10.6 | 125 | 10.8 | 122 |
| DC-1-B | DC-3-B | 25/75 | 5/23/88–6/20/88 | 10.1 | 123 | | |
| DC-1-C | DC-2-C | 75/25 | 7/5/88 | 10.4 | 122 | | |
| DC-1-C | DC-2-C | 50/50 | 7/5/88 | 10 0 | 126 | 10.9 | 132 |
| DC-1-C | DC-2-C | 25/75 | 7/5/88 | 9.7 | 122 | | |
| DC-1-C | DC-3-C | 75/25 | 7/5/88 | 10.2 | 105 | | |
| DC-1-C | DC-3-C | 50/50 | 7/5/88 | 10 0 | 115 | 10.9 | 132 |
| DC-1-C | DC-3-C | 25/75 | 7/5/88 | 10.0 | 110 | | |
| DC-1-D | DC-2-D | 75/25 | 7/11/88 | 10.1 | 126 | | |
| DC-1-D | DC-3-D | 50/50 | 7/11/88 | 9.5 | 124 | 10.6 | 138 |
| DC-1-D | DC-2-D | 25/75 | 7/11/88 | 9.3 | 109 | | |
| DC-1-D | DC-3-D | 75/25 | 7/11/88 | 10.7 | 125 | | |
| DC-1-D | DC-3-D | 50/50 | 7/11/88 | 10.0 | 126 | 10.6 | 135 |
| DC-1-D | DC-3-D | 50/50 | 7/11/88 | 10.0 | 126 | | |
| DC-1-E | DC-2-E | 75/25 | 7/18/88 | 10.7 | 112 | | |
| DC-1-E | DC-2-E | 50/50 | 7/18/88 | 10.2 | 112 | 11.2 | 113 |

TABLE II-continued

SODIUM BENTONITE BINDER MIXTURES

| BASE CLAY | BLEND CLAY | % BLEND | DATE MINED | GCS | DCS | MAX. OF INDIV. CLAYS GCS | MAX. OF INDIV. CLAYS DCS |
|---|---|---|---|---|---|---|---|
| DC-1-E | DC-2-E | 25/75 | 7/18/88 | 9.8 | 117 | | |
| DC-1-E | DC-3-E | 75/25 | 7/18/88 | 10.7 | 121 | | |
| DC-1-E | DC-3-E | 50/50 | 7/18/88 | 10.3 | 132 | 11.2 | 117 |
| DC-1-E | DC-3-E | 25/75 | 7/18/88 | 10.3 | 128 | | |

Foundry sand:
95% silica sand
5% binder

As shown in TABLES I and II, the foundary sand binder containing a combination of DC-1-A having a green compressive strength of 10.6 and a dry compressive strength of 128 combined in a 50/50 mixture with DC-2-A having a green compressive strength of 9.8 and a dry compressive strength of 132 gives a green compressive strength of 10.1 and a dry compressive strength of 140. The marked synergism achieved in the dry compressive strength of 140 compared to the dry compressive strength of 128 of DC-1-A and the dry compressive strength of 132 of DC-2-A is most surprising and unexpected since the combination of these two clays in a 50/50 mixture would be expected to achieve a dry compressive strength of the average of the two clays or 130. DC-1-A is a sodium western bentonite clay mined from this assignee's Colony, Wyoming I mine on May 16, 1988; DC-2-A is a sodium western bentonite clay mined from a different Colony, Wyoming mine of this assignee mined on the same date. The relative strengths of the other properties of hot compressive strength, flowability, surface finish, compressive speed and shakeout for DC-1, DC- 2 and DC-3 are set forth in TABLE III.

TABLE III

| | |
|---|---|
| DC-1 | |
| Green Compressive Strength | 60 |
| Hot Compressive Strength | 24 |
| Dry Compressive Strength | 27 |
| Flowability | 12 |
| Surface Finish | 15 |
| Activation Speed | 12 |
| Shakeout | 9 |
| DC-2 | |
| Green Compressive Strength | 9 |
| Hot Compressive Strength | 9 |
| Dry Compressive Strength | 15 |
| Flowability | 27 |
| Surface Finish | 15 |
| Activation Speed | 27 |
| Shakeout | 24 |
| DC-3 | |
| Green Compressive Strength | 6 |
| Hot Compressive Strength | 21 |
| Dry Compressive Strength | 15 |
| Flowability | 12 |
| Surface Finish | 15 |
| Activation Speed | 12 |
| Shakeout | 12 |

Various blends of DC-1, DC-2 and DC-3 were prepared and used in a foundry sand binder to determine the overall change in properties of the mixture compared to each component alone and the results are set forth in TABLE IV.

TABLE IV

| | |
|---|---|
| Trial 1 | |
| 80% DC-1; 20% DC-2 | |
| Green Compressive Strength | |
| Hot Compressive Strength | 18 |
| Dry Compressive Strength | 24 |
| Flowability | 15 |
| Surface Finish | 18 |
| Activation Speed | 12 |
| Shakeout | 12 |
| Trial 2 | |
| 80% DC-1; 20% DC-2 | |
| Green Compressive Strength | 12 |
| Hot Compressive Strength | 9 |
| Dry Compressive Strength | 18 |
| Flowability | 21 |
| Surface Finish | 18 |
| Activation Speed | 21 |
| Shakeout | 21 |
| Trial 3 | |
| 80% DC-1; 20% DC-2 | |
| Green Compressive Strength | 12 |
| Hot Compressive Strength | 15 |
| Dry Compressive Strength | 18 |
| Flowability | 15 |
| Surface Finish | 18 |
| Activation Speed | 12 |
| Shakeout | 15 |
| Trial 1 | |
| 40% DC-1; 40% DC-2; 20% DC-3 | |
| Green Compressive Strength | 18 |
| Hot Compressive Strength | 15 |
| Dry Compressive Strength | 21 |
| Flowability | 18 |
| Surface Finish | 18 |
| Activation Speed | 18 |
| Shakeout | 15 |
| Trial 2 | |
| 40% DC-1; 40% DC-2; 20% DC-3 | |
| Green Compressive Strength | 15 |
| Hot Compressive Strength | 18 |
| Dry Compressive Strength | 21 |
| Flowability | 12 |
| Surface Finish | 18 |
| Activation Speed | 12 |
| Shakeout | 12 |
| Trial 3 | |
| 40% DC-1; 40% DC-2; 20% DC-3 | |
| Green Compressive Strength | 9 |
| Hot Compressive Strength | 12 |
| Dry Compressive Strength | 15 |
| Flowability | 18 |
| Surface Finish | 18 |
| Activation Speed | 18 |
| Shakeout | 18 |
| 60% DC-1; 20% DC-2; 20% DC-3 | |
| Green Compressive Strength | 18 |
| Hot Compressive Strength | 15 |
| Dry Compressive Strength | 21 |
| Flowability | 18 |
| Surface Finish | 18 |
| Activation Speed | 18 |
| Shakeout | 15 |
| Trial 1 | |
| 20% DC-1; 60% DC-2; 20% DC-3 | |
| Green Compressive Strength | 18 |
| Hot Compressive Strength | 15 |
| Dry Compressive Strength | 21 |

TABLE IV-continued

| | |
|---|---|
| Flowability | 18 |
| Surface Finish | 18 |
| Activation Speed | 18 |
| Shakeout | 15 |
| Trial 2 | |
| 20% DC-1; 60% DC-2; 20% DC-3 | |
| Green Compressive Strength | 15 |
| Hot Compressive Strength | 18 |
| Dry Compressive Strength | 21 |
| Flowability | 12 |
| Surface Finish | 18 |
| Activation Speed | 12 |
| Shakeout | 12 |
| Trial 3 | |
| 20% DC-1; 60% DC-2; 20% DC-3 | |
| Green Compressive Strength | 9 |
| Hot Compressive Strength | 12 |
| Dry Compressive Strength | 15 |
| Flowability | 18 |
| Surface Finish | 18 |
| Activation Speed | 18 |
| Shakeout | 18 |
| Trial 1 | |
| 60% DC-1; 20% DC-2; 20% DC-3 | |
| Green Compressive Strength | 15 |
| Hot Compressive Strength | 18 |
| Dry Compressive Strength | 21 |
| Flowability | 12 |
| Surface Finish | 18 |
| Activation Speed | 12 |
| Shakeout | 12 |
| Trial 2 | |
| 60% DC-1; 20% DC-2; 20% DC-3 | |
| Green Compressive Strength | 9 |
| Hot Compressive Strength | 12 |
| Dry Compressive Strength | 15 |
| Flowability | 18 |
| Surface Finish | 18 |
| Activation Speed | 18 |
| Shakeout | 18 |

As shown in TABLE IV, the surface finish for all Trials 1, 2 and 3 of 80% DC-1 and 20% DC-2 combined, gave a surface finish of 18 whereas the surface finish for DC-1 alone or DC-2 alone were each (TABLE III). Accordingly, it has been found that combinations of DC-1 and DC-2 give synergistic and unexpected results in terms of a high quality surface finish on cast metal parts when a combination of DC-1 and DC-2 are used as a binder in foundry sand molding. Similarly, as shown in TABLE IV, the surface finish for 40% DC-2 and 20% DC-3 was unexpectedly improved in all three trials of this mixture compared to the surface finish of each of DC-1, DC-2 and DC-3 alone. As further shown in TABLE IV, the unexpected surface finish is also achieved with combinations of 60% DC-1, 20% DC-2 and 20% DC-3; 20% DC-1, 60% DC-2 and 20% DC-3 as well as 60% DC-1, 20% DC-2 and 20% DC-3.

Many modifications can be made to, and additives included in the molding sands containing the blend of sodium bentonite clay binders in accordance with the present invention.

I claim:

1. A method of manufacturing a cast metal part including forming a foundry sand mixture comprising sand and a binder, shaping the foundry sand mixture into a shape having at least one surface with a desired configuration and thereafter pouring molten metal in contact with said shaped surface of the foundry sand mixture to solidify while in contact with said shaped surface of the foundary sand mixture, said binder comprising a combination of at least two sodium bentonite clays each present in an amount of 25% by weight to 75% by weight of total clay binders in the foundry sand mixture, obtained from different deposits and having different values for green compressive strength, dry compressive strength or surface finish, such that in combination, the green compressive strength, the dry compressive strength or the surface finish is greater than for each sodium bentonite clay alone.

2. The method of claim 1 further including one or more additives selected from the group consisting of cellulose, cereal, fibrous additives, a cement, a resin, china clay and an oil in an amount of about 0.5% to about 20% based on the dry weight of the foundry sand mixture.

3. The method of claim 2 wherein the foundry stand mixture includes a cellulose material selected from the group consisting of wood flour, rye flour, wheat flour, corn flour, oat hulls, rice hulls, alfalfa fines, grain chaff, flax seed pressings, corn cob flour, pulverized nutshells, and ground cotton-seed pulp in an amount of about 0.5% to about 5% based on the total dry weight of the foundry sand mixture.

4. The method of claim 1 wherein the foundry sand mixture includes a carbonaceous material selected from the group consisting of graphite, pitch, charcoal, coal, and coke in an amount of about 0.1% to about 10% based on the total dry weight of the foundry sand mixture.

5. The method of claim 1 wherein the sodium bentonite clay binders are included in the foundry sand mixture in an amount of about 2% by weight to about 15% by weight of the foundry sand mixture.

* * * * *

UNITED STATES PATENT AND TRADEMARK OFFICE

CERTIFICATE OF CORRECTION

PATENT NO. : 5,333,673

DATED : AUGUST 2, 1994

INVENTORS : JOHN HUGHES

It is certified that error appears in the above-identified patent and that said Letters Patent is hereby corrected as shown below:

Column 1, line 12, after "swellable" delete "bent onites" and substitute therefor -- bentonites --;

Column 1, line 25, after "from" delete "temper ed" and substitute therefor -- tempered --;

Column 1, line 50, after "sodium" delete "bentonitc" and substitute therefor -- bentonite --;

Column 1, lines 50, 51, after "calcium" delete "bentonitc" and substitute therefor -- bentonite --;

Column 2, line 33, after "sodium" delete "bentonitc" and substitute therefor -- bentonite --;

Column 2, line 53, after "refractor" delete "4";

Column 2, line 66, after "sodium" delete "bentonire" and substitute therefor -- bentonite --;

Column 3, line 4, after "binder," delete "foundary" and substitute therefor -- foundry --;

Column 3, line 34, after "sodium" delete "bentonire" and substitute therefor -- bentonite --;

Column 4, line 17, delete "bentonire," and substitute therefor -- bentonite, --;

UNITED STATES PATENT AND TRADEMARK OFFICE

CERTIFICATE OF CORRECTION

PATENT NO. : 5,333,673

DATED : AUGUST 2, 1994

INVENTORS : JOHN HUGHES

It is certified that error appears in the above-identified patent and that said Letters Patent is hereby corrected as shown below:

Column 4, line 27, after "sodium" delete "bentonire." and substitute therefor -- bentonite. --;

Column 4, line 44, after "sodium" delete "bentonires" and substitute therefor -- bentonites --;

Column 7, line 15, after "the" delete "foundary" and substitute therefor -- foundry --;

Column 7, line 35, after "finish" delete "compressive" and substitute therefor -- activation --;

Column 7, TABLE IV, the column after "Green Compressive Strength" should have the number -- 21 --;

Column 9, line 41, before "(TABLE III)" insert -- 15 --;

Column 9, line 46, before "40%" insert -- 40% DC-1, --;

UNITED STATES PATENT AND TRADEMARK OFFICE

CERTIFICATE OF CORRECTION

PATENT NO. : 5,333,673

DATED : AUGUST 2, 1994

INVENTORS : JOHN HUGHES

It is certified that error appears in the above-identified patent and that said Letters Patent is hereby corrected as shown below:

Column 10, line 16, after "the" delete "foundary" and substitute therefor -- foundry --;

Column 10, line 33, after "foundry" delete "stand" and substitute therefor -- sand --; and Column 10, line 37, after "pulverized" delete "nutshells," and substitute therefor -- nut hulls, --.

Signed and Sealed this

First Day of November, 1994

Bruce Lehman

*Attest:*

BRUCE LEHMAN

*Attesting Officer*

*Commissioner of Patents and Trademarks*